US009874888B2

(12) United States Patent
Bernardon

(10) Patent No.: US 9,874,888 B2
(45) Date of Patent: Jan. 23, 2018

(54) ADAPTIVE CONTROL FOR LINEAR VOLTAGE REGULATOR

(71) Applicant: Infineon Technologies AG, Neubiberg (DE)

(72) Inventor: Derek Bernardon, Villach (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/177,116

(22) Filed: Jun. 8, 2016

(65) Prior Publication Data

US 2017/0357278 A1 Dec. 14, 2017

(51) Int. Cl.
*G05F 1/575* (2006.01)
*G05F 1/595* (2006.01)

(52) U.S. Cl.
CPC ..... *G05F 1/575* (2013.01); *G05F 1/595* (2013.01)

(58) Field of Classification Search
CPC ..... G05F 1/575; G05F 1/595; G05F 1/565; G05F 1/59
See application file for complete search history.

(56) References Cited

U.S. PATENT DOCUMENTS 5,939,867 A 8/1999 Capici et al.
6,188,212 B1 2/2001 Larson et al.
6,522,111 B2 2/2003 Zadeh et al.
7,166,991 B2 1/2007 Eberlein
7,202,746 B1 4/2007 Kejariwal et al.
7,248,117 B1 * 7/2007 Li ..... H03F 1/086 330/260
7,589,507 B2 9/2009 Mandal
2007/0030074 A1 * 2/2007 Ritter ..... H03F 1/34 330/292
2011/0163797 A1 * 7/2011 Posat ..... H03K 17/0822 327/537
2012/0126760 A1 5/2012 Vemula
2015/0008893 A1 1/2015 Motz

OTHER PUBLICATIONS

Jackum, "Alternative Concepts for Linear Voltage Regulators in Deep Sub-Micron Technologies," Graz University of Technology, Institute of Electronics, Thesis, Oct. 2013, 112 pp.
Li, "A NMOS Linear Voltage Regulator for Automotive Applications," Delft University of Technology, Thesis, Oct. 2012, 100 pp.

* cited by examiner

*Primary Examiner* — Harry Behm
(74) *Attorney, Agent, or Firm* — Shumaker & Sieffert, P.A.

(57) ABSTRACT

In one example, a circuit includes a voltage source, a pass module, a differential amplifier module, and a control module. The pass module is configured to electronically couple, using a channel having a resistance, the voltage source and a load and to modify the resistance of the channel based on a control signal. The differential amplifier module is configured to generate a differential signal based on a comparison of a voltage reference and a representation of a voltage at the load. The control signal is based on the differential signal. The control module is configured to generate the representation of the voltage at the load according to a transfer function. The transfer function includes a zero positioned substantially at a crossover frequency of the transfer function.

19 Claims, 8 Drawing Sheets

ADAPTIVE CONTROL FOR LINEAR VOLTAGE REGULATOR

TECHNICAL FIELD

This disclosure relates to a linear voltage regulator, such as a low-dropout (LDO) regulator, that is configured to regulate an output voltage.

BACKGROUND

Linear voltage regulators may regulate an output voltage. For example, a linear voltage regulator may output a voltage of 5 volts using a supplied voltage of 10 volts. A low-dropout (LDO) regulator may regulate an output voltage that is close to a supplied voltage. For instance, an LDO regulator may output a voltage of 5 volts using a supplied voltage of 5.5 volts. In any case, it may be desirable for linear voltage regulators, such as LDO regulators, to have a high dynamic performance (e.g., quickly achieve a regulated voltage), no load stability (e.g., regulate the output voltage with a small load current or no load current), and have a low current consumption (e.g., low quiescent current).

SUMMARY

In general, this disclosure is directed to techniques for permitting a low-dropout (LDO) regulator to remain stable during a full range of load current (e.g., no load to full load) while maintaining a dynamic performance and limiting current consumption. In an exemplary application of automobiles, such an LDO regulator may regulate a voltage for use by electrical load devices (e.g., interior car light) while the automobile is parked with the engine off. In some examples, rather than requiring a minimum load current, an LDO regulator may dynamically generate a zero at an open loop transfer function's crossover frequency. Said differently, rather than necessarily limiting a load current, an LDO regulator may effectively dampen the voltage regulation control when the output voltage (e.g., 5 volts) corresponds to a desired output voltage to permit the LDO to remain stable at a low load current as well as a high load current. In some examples, such a dampening may be varied according to the load current of an LDO regulator. For instance, as a load current decreases the dampening may increase such that the LDO regulator may effectively dampen the voltage regulation control when the load current is very low (e.g., less than 50 μA) or there is no load current.

In an example, a circuit includes a voltage source, a pass module, a differential amplifier module, and a control module. The pass module is configured to electronically couple, using a channel having a resistance, the voltage source and a load and to modify the resistance of the channel based on a control signal. The differential amplifier module is configured to generate a differential signal based on a comparison of a voltage reference and a representation of a voltage at the load. The control signal is based on the differential signal. The control module is configured to generate the representation of the voltage at the load according to a transfer function. The transfer function includes a zero positioned substantially at a crossover frequency of the transfer function.

In another example, a method includes determining, by a circuit, a representation of a load current at a load and generating, by the circuit, a zero at a crossover frequency of a transfer function for controlling a voltage at the load to generate a representation of a voltage at the load. The generating the zero at the crossover frequency of the transfer function is based on the representation of the load current. The method further includes outputting, by the circuit, a control signal responsive to a difference between the representation of the voltage at the load and a reference voltage and controlling, by the circuit, the voltage at the load according to the control signal.

In another example, a circuit includes a current sensing unit, a control module, a differential amplifier module, and a pass module. The current sensing unit is configured to determine a representation of a load current at a load. The control module is configured to generate a zero at a crossover frequency of a transfer function for controlling a voltage at the load to generate a representation of a voltage at the load. The zero at the crossover frequency of the transfer function is based on the representation of the load current. The differential amplifier module is configured to output a control signal responsive to a difference between the representation of the voltage at the load and a reference voltage. The pass module is configured to control the voltage at the load according to the control signal.

Details of these and other examples are set forth in the accompanying drawings and the description below. Other features, objects, and advantages will be apparent from the description and drawings, and from the claims.

DETAILED DESCRIPTION

Some systems may use a low-dropout (LDO) regulator. For example, an LDO regulator may output a voltage of 5 volts to activate electrical loads (e.g., a dome light, car horn, door lock actuator, or another electrical load) that are powered by a battery while an automobile is parked with the engine off. However, such circuits may necessarily be designed to maintain a minimum load current through the LDO regulator in order for the LDO regulator to remain stable (e.g., regulate the voltage to 5 volts).

In some examples, rather than limiting an LDO regulator to applications that maintain a suitable minimum load current, an LDO regulator may generate a zero at an open-loop transfer function's crossover frequency to permit the LDO regulator to remain stable at a full range of current. For example, an LDO regulator may include a zero generation unit that provides a capacitor and resistive combination in a feedback into the LDO regulator that generates the zero at the open-loop transfer function's crossover frequency. Moreover, in some examples, the LDO regulator may dynamically change a resistance of the resistive combination according to a load current to maximize the phase margin for a specific load current.

Additionally, rather than relying on resistors and capacitors that are susceptible to changes in temperature and process variations to provide accurate current sensing for generating the zero, an LDO regulator may include a current sensing unit that uses transistors (e.g., a N-channel depletion field-effect transistor) to mirror the load current. In this manner, the LDO regulator may quickly and accurately determine a load current for precisely generating the zero at the open-loop transfer function's crossover frequency.

Further, rather than relying on an operational transconductance amplifier ("OTA"), which controls a current output from the OTA, to control an LDO regulator, an LDO regulator may include an operational amplifier ("opamp"), which controls a voltage output from the operation amplifier. More specifically, the operation amplifier may permit a capacitor to be used at a gate to reduce electromagnetic interference (EMI) of the LDO regulator and/or improve a direct power injection measurement of the LDO regulator. In examples where the operation amplifier has a low output impedance, a pole of the capacitor may be pushed up to very high frequencies which do not interfere with the control (e.g., the generation of the zero at the open-loop transfer function's crossover frequency) of the LDO regulator.

Figure 1:
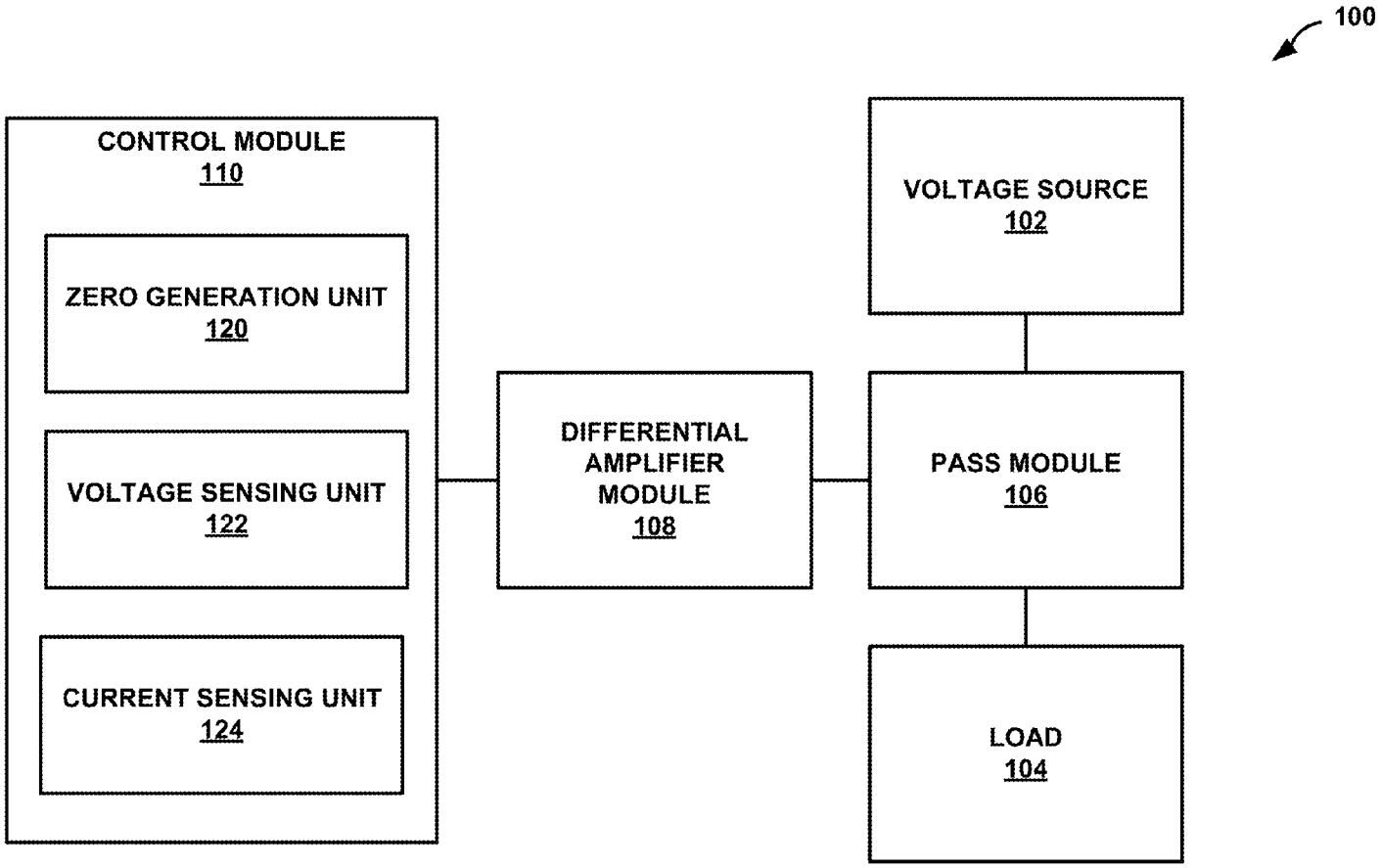
FIG. 1 is a block diagram illustrating an example system configured to remain stable during a full range of load current, in accordance with one or more techniques of this disclosure.

FIG. 1 is a block diagram illustrating an example system 100 configured to remain stable during a full range of load current, in accordance with one or more techniques of this disclosure. As illustrated in the example of FIG. 1, system 100 may include voltage source 102, load 104, pass module 106, differential amplifier module 108, and control module 110.

Voltage source 102 may be configured to provide electrical power to one or more other components of system 100. For instance, voltage source 102 may be configured to supply an input power to load 104. In some examples, voltage source 102 include a battery which may be configured to store electrical energy. Examples of batteries may include, but are not limited to, nickel-cadmium, lead-acid, nickel-metal hydride, nickel-zinc, silver-oxide, lithium-ion, lithium polymer, any other type of rechargeable battery, or any combination of the same. In some examples, voltage source 102 may include an output of a power converter or power inverter. For instance, voltage source 102 may include an output of a direct current (DC) to DC power converter, an alternating current (AC) to DC power converter, and the like. In some examples, voltage source 102 may represent a connection to an electrical supply grid. In some examples, the input power signal provided by voltage source 102 may be a DC input power signal. For instance, in some examples, voltage source 102 may be configured to provide a DC input power signal in the range of ~5 VDC to ~40 VDC.

Load 104 may include devices configured to accept, via pass module 106, current from voltage source 102. In some examples, load 104 may be resistive. Examples of resistive loads may include seat adjustment, auxiliary heating, window heating, light emitting diodes (LEDs), rear lighting, or other resistive loads. In some examples, load 104 may be inductive. Examples of inductive loads may include actuators, motors, and pumps used in one or more of a wiper system, anti-lock brake system (ABS), electronic braking system (EBS), relay, battery disconnect, fan, or other systems that include inductive loads. In some examples, load 104 may be capacitive. Examples of capacitive loads may include lighting elements, such as a Xenon arc lamp.

Pass module 106 may include any device suitable to control an amount of current flowing through pass module 106. More specifically, in some examples, pass module 106 may be configured to electronically couple, using a channel having a resistance, voltage source 102 and load 104 and to modify the resistance of the channel based on a control signal. For example, pass module 106 may include one or more pass elements that may each be switched to control a current flow through a respective pass element. Examples of pass elements may include, but are not limited to, silicon controlled rectifier (SCR), a Field Effect Transistor (FET), and bipolar junction transistor (BJT). Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, depletion mode p-channel MOSFET (PMOS), enhancement mode PMOS, depletion mode n-channel MOSFET (NMOS), enhancement mode NMOS, double-diffused MOSFET (DMOS), or any other type of MOSFET, or any combination of the same. Examples of BJTs may include, but are not limited to, PNP, NPN, heterojunction, or any other type of BJT, or any combination of the same. It should be understood that pass elements may be a high side or low side. Additionally, pass elements may be voltage-controlled and/or current-controlled. Examples of current-controlled switching elements may include, but are not limited to, gallium nitride (GaN) MOSFETs, BJTs, or other current-controlled elements.

Differential amplifier module 108 may be configured to generate a differential signal based on a comparison of a voltage reference and a representation of a voltage at load 104. In some examples, as described further, the differential signal may be used to generate the control signal that controls an amount of current flowing through pass module 106. Differential amplifier module 108 may include any device suitable to amplify a difference of between two input voltages. In some examples, differential amplifier module 108 may include a differential amplifier unit. A differential amplifier unit may have a higher differential-mode gain, higher input impedance and lower output impedance as compared to an operational amplifier. Differential amplifier module 108 may include a set of resistive elements configured to receive an output voltage at load 104 and output a voltage corresponding to the voltage at load 104. For example, the set of resistive elements may form a voltage divider that outputs a ratio such that the voltage corresponding to the voltage at load 104 is a voltage suitable for use by the differential amplifier unit. Differential amplifier module 108 may include one or more capacitors to provide control stability and improve a control performance.

The voltage reference used by differential amplifier module 108 may be any suitable reference. For example, the voltage reference may be an output from a controller. In some examples, the controller may be a microcontroller on a single integrated circuit containing a processor core, memory, inputs, and outputs. For example, the controller may include one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. In some examples, the controller may be a combination of one or more analog components and one or more digital components.

Control module 110 may be configured to generate a zero at an open-loop transfer function's crossover frequency to permit system 100 to remain stable at a full range of current. As shown, control module 110 may include zero generation unit 120, voltage sensing unit 122, and current sensing unit 124.

Current sensing unit 124 may be configured to estimate a current flowing from voltage source 102, via pass module 106, to load 104. In some examples, current sensing unit 124 may include one or more transistors configured to mirror the current flowing from voltage source 102, via pass module 106, to load 104. Examples of such transistors may include, but are not limited to, depletion mode PMOS, enhancement mode PMOS, depletion mode NMOS, enhancement mode NMOS, DMOS, or any other type of MOSFET, or any combination of the same. In some examples, transistors configured to mirror current may be matched to improve an accuracy of the estimated current flowing from voltage source 102, via pass module 106, to load 104.

Voltage sensing unit 122 may be configured to estimate a voltage supplied to load 104. In some examples, voltage sensing unit 122 may include one or more transistors configured to mirror the voltage at load 104. Examples of such transistors may include, but are not limited to, depletion mode PMOS, enhancement mode PMOS, depletion mode NMOS, enhancement mode NMOS, DMOS, or any other type of MOSFET, or any combination of the same. In some examples, transistors configured to mirror voltage may be matched to improve an accuracy of the estimated voltage at load 104.

Zero generation unit 120 may be configured to generate a zero at an open-loop transfer function's crossover frequency. In some examples, zero generation unit 120 may include a transistor unit that is configured to modify a resistance of a channel to control a placement of the zero at the open-loop transfer function's crossover frequency according to a load current at load 104. Each transistor unit may include a set of transistors. For instance, a transistor unit may include two matched depletion mode PMOS transistors with gates coupled together. In this manner, zero generation unit 120 may move the zero according to the current at load 104. For instance, zero generation unit 120 may move the zero according to a representation of the current at load 104 that is generated by current sensing unit 124. Zero generation unit 120 may include a capacitor coupled to the transistor unit such that the capacitor and the resistance of the channel of the transistor unit generate the zero at an open-loop transfer function's crossover frequency based on the representation of the current at load 104. In this manner, system 100 may remain stable at a full range of current at load 104.

Rather than limiting a system to applications that operate in excess of a minimum load current and rather than generating a zero onto a pole generated by load 104, system 100 may generate a zero at an open-loop transfer function's crossover frequency. In this manner, system 100 may be used in applications that operate with low load current (e.g., less than 50 μA) and/or no load current as well as with high current (e.g., a maximum current rating of a pass element of pass module 106). Additionally, since system 100 generates the zero at the open-loop transfer function's crossover frequency instead of onto the pole generated by load 104, system 100 may have an increased phase margin than systems that generate a zero onto the pole generated by load 104, thereby providing further stability. Further, since system 100 may generate the zero at the open-loop transfer function's crossover frequency using current mirrors and voltage mirrors instead of relying on resistors and capacitors that are susceptible to changes in temperature and process variations, system 100 may have an increased phase margin than systems that rely on resistors and capacitors, thereby providing even further stability.

In accordance with one or more techniques described, system 100 determines a representation of a load current at load 104. For example, current sensing unit 124 may mirror, using a set of matched depletion mode NMOS transistors, the current flowing from voltage source 102, via pass module 106, to load 104. System 100 generates a zero at a crossover frequency of a transfer function for controlling a voltage at load 104 that is based on the representation of the load current to generate a representation of a voltage at load 104. For example, zero generation unit 120 controls, based on a mirrored current received from current sensing unit 124, a transistor unit of zero generation unit 120 such that a resistance of a channel of the transistor unit generates a zero at the crossover frequency of the transfer function for controlling the voltage at load 104. In the example, zero generation unit 120 may generate a representation of a voltage at load 104 by outputting, to a negative input of a differential amplifier unit of differential amplifier module 108, a voltage that is generated using a voltage output from the transistor unit of zero generation unit 120.

System 100 outputs a control signal responsive to a difference between the representation of the voltage at load 104 and a reference voltage. For example, a differential amplifier unit of differential amplifier module 108 generates a differential signal based on a comparison of a reference voltage and the representation of a voltage at load 104 that is output by zero generation unit 120 of control module 110. In the example, a mirrored pass element of pass module 106 receives the differential signal and generates the control signal. System 100 controls the voltage at load 104 according to the control signal. For example, a depletion mode NMOS of pass module 106 may receive the control signal at a gate and adjust a resistance of a channel of the depletion mode NMOS connecting voltage source 102 and load 104 according to the control signal such that the voltage at load 104 is approximately 5 volts (e.g., 4.9 volts to 5.1 volts, 4.99 volts to 5.01 volts, or another voltage range).

In this manner, one or more techniques described permit system 100 to remain stable at a full range of load current. For example, zero generation unit 120 may provide a capacitor and resistive combination in a feedback into the differential amplifier module 108 that generates the zero at the open-loop transfer function's crossover frequency. Additionally, rather than relying on resistors and capacitors that are susceptible to changes in temperature and process variations to provide accurate current sensing for generating the zero, system 100 may include a current sensing unit that uses transistors (e.g., a depletion mode NMOS) to mirror the load current. In this manner, system 100 may quickly and accurately determine a load current for precisely generating the zero at the open-loop transfer function's crossover frequency.

Figure 2:
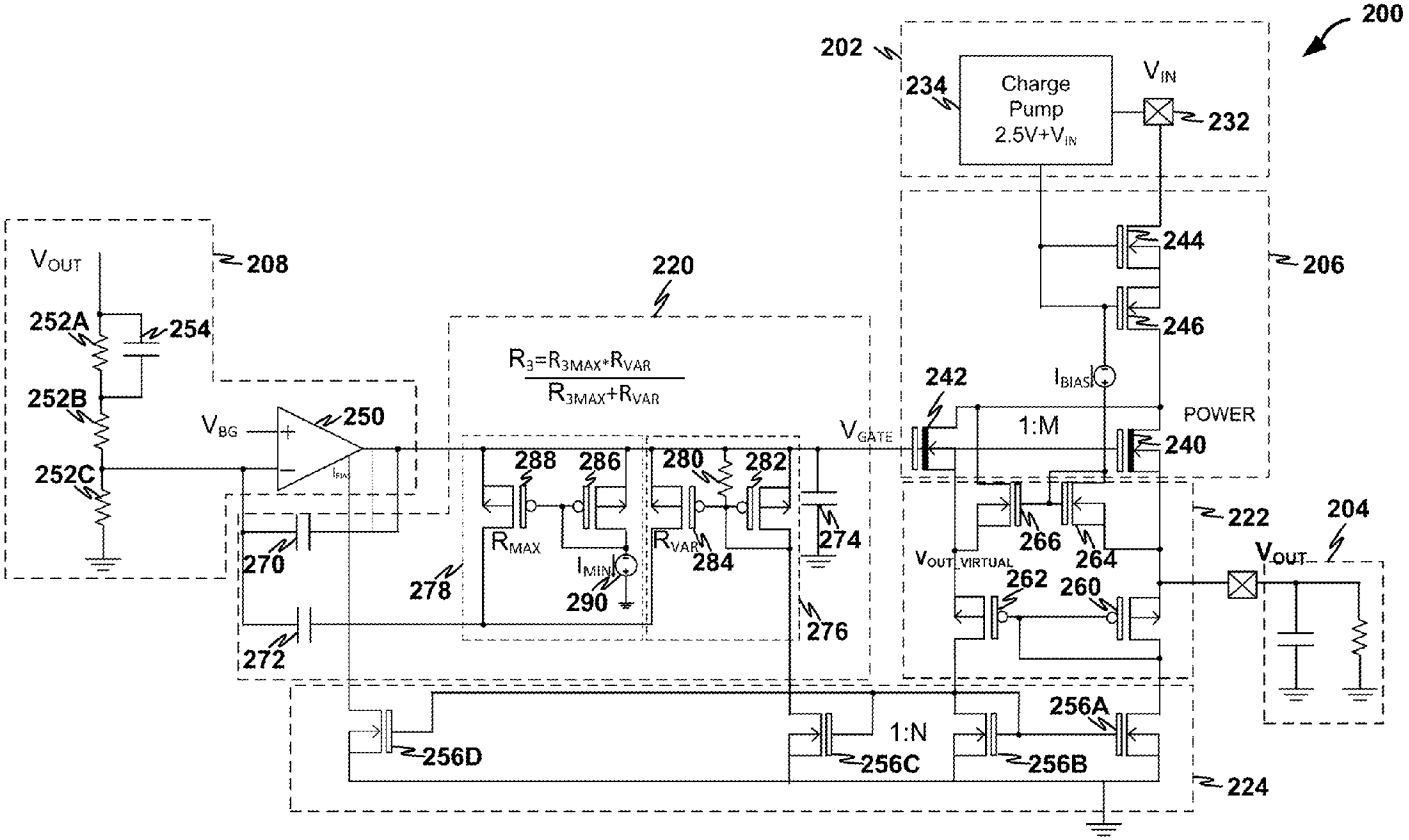
FIG. 2 is a circuit diagram illustrating an example first circuit of the system of FIG. 1, in accordance with one or more techniques of this disclosure.

FIG. 2 is a circuit diagram illustrating an example first circuit 200 of system 100 of FIG. 1, in accordance with one or more techniques of this disclosure. As illustrated, circuit 200 includes voltage source 202, load 204, pass module 206, differential amplifier module 208, and zero generation unit 220, voltage sensing unit 222, and current sensing unit 224. Voltage source 202 may be an example of voltage source 102 of FIG. 1. Load 204 may be an example of load 104 of FIG. 1. For example, as shown, load 204 may be resistive and capacitive. Pass module 206 may be an example of pass module 106 of FIG. 1. Differential amplifier module 208 may be an example of differential amplifier module 108 of FIG. 1. Zero generation unit 220, voltage sensing unit 222, and current sensing unit 224 may be an example of control module 110 of FIG. 1. For example, zero generation unit 220 may be an example of zero generation unit 120, voltage sensing unit 222 may be an example of voltage sensing unit 122 of FIG. 1, and current sensing unit 224 may be an example of current sensing unit 124 of FIG. 1.

Voltage source 202 may include an input voltage 232 and charge pump 234. Input voltage 232 may be an output of a battery, a DC to DC power converter, an AC to DC power converter, or another input voltage. Charge pump 234 may be configured to increase a voltage supplied by input voltage 232 using capacitors.

Pass module 206 may include load pass element 240, mirrored pass element 242, first pass element 244, and second pass element 246. Although the example of FIG. 2, illustrates load pass element 240, mirrored pass element 242, first pass element 244, and second pass element 246 as enhancement mode NMOSs, in other examples load pass element 240, mirrored pass element 242, first pass element 244, and/or second pass element 246 may be another pass element.

Mirrored pass element 242 may be configured to receive a differential signal and to generate a control signal. For example, mirrored gate element 242 may receive, at a gate of mirrored pass element 242 and from differential amplifier module 208, a differential signal, and in response to receiving the differential signal, generate the control signal. As shown, a drain of mirrored pass element 242 is coupled to a drain of load pass element 240, and a source of mirrored pass element 242 is coupled to a virtual output of voltage sensing unit 222 and to a gate of load pass element 240. Load pass element 240 may be configured to control an amount of current flowing through load pass element 240 according to the control signal. As shown, a source of load pass element 240 may be coupled to load 204 and a drain of load pass element 240 may be coupled to a drain of second pass element 246.

First pass element 244 may be configured to further reduce the voltage at load 204 when load pass module 206 operates in an off state. For example, rather than only operating load pass element 240 in an open state, which may permit a load voltage (e.g., less than 0.5 volts) at load 204 to remain, first pass element 244 may further reduce the load voltage at load 204 to substantially zero volts (e.g., less than 0.1 volts). As shown, a drain of first pass element 244 may be coupled to input voltage 232 of voltage source 202, a gate of first pass element 244 may be coupled to charge pump 234 of voltage source 202, and a source of first pass element 244 may be coupled to a drain of second pass element 246.

Second pass element 246 may be configured to prevent current to flow from load 204 to voltage source 202. For example, second pass element 246 may prevent current from flowing from load 204 to voltage source 202 using a parasitic diode of second pass element 246 that blocks the current, thereby allowing first pass element 244 and second pass element 246 to have parasitic diodes that permit the current from flowing from load 204 to voltage source 202. As shown, a drain of second pass element 246 may be coupled to a drain of load pass element 240, a gate of second pass element 246 may be coupled to charge pump 234 of voltage source 202, and a source of second pass element 246 may be coupled to a source of first pass element 244. In this manner, first pass element 244 and second pass element 246 may operate fully on (e.g., saturation or active mode rather than linear, triode, or ohmic mode), thereby having no dynamic current requirements to reduce a current consumption of charge pump 234 of voltage source 202.

Differential amplifier module 208 may be configured to generate a differential signal based on a comparison of a voltage reference and a representation of a voltage at the load. As shown, differential amplifier module 208 includes a differential amplifier unit 250, resistive elements 252A, 252B, and 252C ("set of resistive elements 252"), and capacitor 254. Differential amplifier unit 250 may be any electrical device that outputs an amplified difference between a first voltage received at a first input of differential amplifier unit 250 and a second voltage received at a second input of differential amplifier unit 250. For example, differential amplifier unit 250 may output, to a gate of mirrored pass element 242 of pass module 206, an amplified difference between a voltage reference received at a first input (e.g., positive input) of differential amplifier unit 250 and a voltage received at a second input (e.g., negative input) of differential amplifier unit 250.

Current sensing unit 224 may be configured to mirror current flow at load 204. As shown, current sensing unit 224 includes transistors 256A-D. In some examples, transistors 256A-D may be matched such that current flowing in each of transistors 256A-D may precisely correspond with current flowing in the other transistors 256A-D. In this manner, a current at load 204 may be detected by transistor 256A and mirrored, by a scaling factor of 1:M, by transistor 256B, which in turn is mirrored, by a scaling factor of 1:N, by transistor 256C, which in turn is mirrored by transistor 256D to provide a current bias to differential amplifier unit 250 of differential amplifier module 208.

Voltage sensing unit 222 may be configured to mirror voltage at load 204. As shown, voltage sensing unit 222 includes transistors 260, 262, 264, and 266. In some examples, transistors 260, 262, 264, and 266 may be matched such that current flowing in each of transistors 260, 262, 264, and 266 may precisely correspond with current flowing in the other transistors 260, 262, 264, and 266. In this manner, transistors 260 and 262 may form a p-channel source following that detects a voltage at load 204 and mirrors, by a scaling factor of 1:M, the voltage at a source of transistor 262. Additionally, transistors 264 and 266 may form an n-channel source follower that ensures that a stability of circuit 200 by providing current into the p-channel source follower formed by transistors 260 and 262 when the current at load 204 drops to zero.

Zero generation unit 220 may be configured to generate a zero at an open-loop transfer function's crossover frequency. As shown, zero generation unit 220 includes capacitors 270, 272, and 274, and transistor units 276 and 278. Capacitor 274 may reduce an electromagnetic interference of circuit 200 and/or improve a direct power injection measurement of circuit 200. Set of resistive element 252 of differential amplifier module 208 may be configured to receive the voltage at load 204 and output, to capacitors 270 and 272, a voltage corresponding to the voltage at load 204. Transistor unit 276 may be configured to electronically couple, using a channel having a resistance, an output of differential amplifier unit 250 of differential amplifier module 208 to, via capacitor 272, a second input (e.g., negative) of differential amplifier unit 250 of differential amplifier module 208. As shown, transistor unit 276 includes transistors 282 and 284 and resistor 280. Transistor 282 provides a voltage to the gate of transistor 284 that corresponds to the current mirrored by transistor 256C of current sensing unit 224. Resistor 280 may optionally be included to provide further control stability. Transistor unit 278 may be configured to electronically couple capacitor 272 and the output of differential amplifier unit 250 of differential amplifier module 208 with a resistance that represents a maximum resistance between capacitor 272 and the output of differential amplifier unit 250 of differential amplifier module 208. As shown, transistor unit 278 includes transistors 286, 288, and current source 290. Transistor 286 provides a voltage to the gate of transistor 288 that corresponds to a current of current source 290.

In this manner, one or more techniques described permit circuit 200 to remain stable at a full range of load current. For example, zero generation unit 220 may provide capacitor 272 and transistor unit 276 in a feedback into differential amplifier unit 250 of differential amplifier module 208 that generates the zero at the open-loop transfer function's crossover frequency. Additionally, rather than relying on resistors and capacitors that are susceptible to changes in temperature and process variations to provide accurate current sensing for generating the zero, circuit 200 may include current sensing unit 224 that uses transistors 256A-D to mirror the load current. In this manner, circuit 200 may quickly and accurately determine a load current for precisely generating the zero at the open-loop transfer function's crossover frequency.

Figure 3:
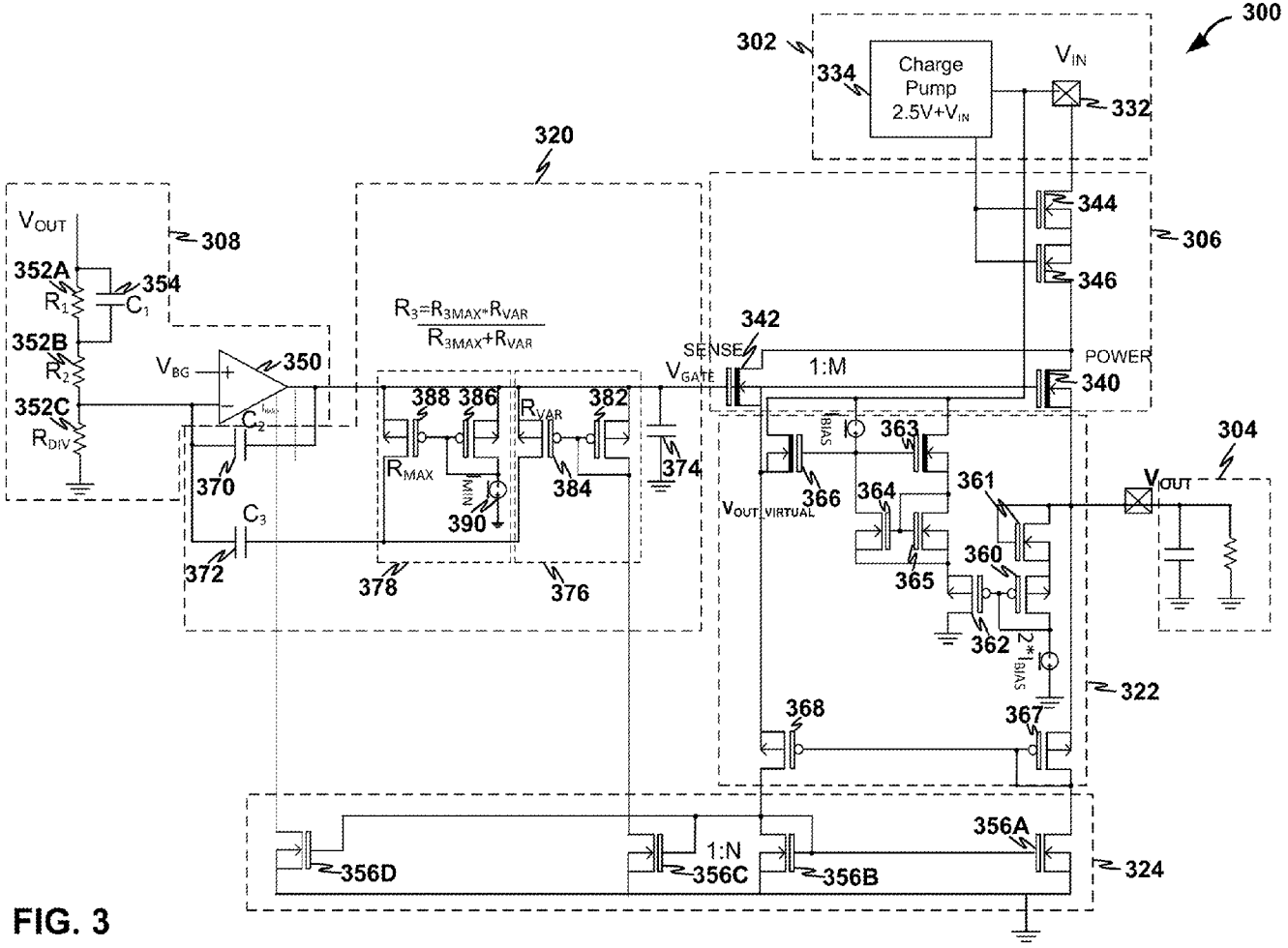
FIG. 3 is a circuit diagram illustrating an example second circuit of the system of FIG. 1, in accordance with one or more techniques of this disclosure.

FIG. 3 is a circuit diagram illustrating an example second circuit 300 of system 100 of FIG. 1, in accordance with one or more techniques of this disclosure. As illustrated, circuit 300 includes voltage source 302, load 304, pass module 306, differential amplifier module 308, and zero generation unit 320, voltage sensing unit 322, and current sensing unit 324.

Voltage source 302 may be substantially similar to voltage source 202 of FIG. 2. For example, voltage source 302 may include input voltage 332 that is substantially similar to input voltage 232 of FIG. 2 and charge pump 334 that is substantially similar to charge pump 234 of FIG. 2. Load 304 may be substantially similar to load 204 of FIG. 2. For example, load 304 may be resistive and capacitive.

Pass module 306 may be substantially similar to pass module 206 of FIG. 2. For example, pass module 306 may include load pass element 340 that is substantially similar to load pass element 240 of FIG. 2, mirrored pass element 342 that is substantially similar to mirrored pass element 242 of FIG. 2, first pass element 344 that is substantially similar to first pass element 244 of FIG. 2, and second pass element 346 that is substantially similar to second pass element 246 of FIG. 2.

Differential amplifier module 308 may be substantially similar to differential amplifier module 208 of FIG. 2. For example, differential amplifier module 308 may include differential amplifier unit 350 that is substantially similar to differential amplifier unit 250 of FIG. 2, resistive elements 352A, 352B, and 352C ("set of resistive elements 352") that are substantially similar to set of resistive elements 252 of FIG. 2, and capacitor 354 that is substantially similar to capacitor 254.

Zero generation unit 320 may be substantially similar to zero generation unit 220 of FIG. 2. For example, zero generation unit 320 may include capacitors 370, 372, and 374 that are substantially similar to capacitors 270, 272, and 274 of FIG. 2, transistor units 376 and 378 that are substantially similar to transistor units 276 and 278 of FIG. 2. As shown, resistor 280 of FIG. 2 is omitted from zero generation unit 320. However, in some examples, zero generation unit 320 may include a resistor coupled to the output of differential amplifier unit 350 to the gates of transistors 382 and 384. In the example of FIG. 3, transistor unit 378 includes transistors 386 and 388 and current source 390.

Current sensing unit 324 may substantially similar to current sensing unit 224 of FIG. 2. For example, current sensing unit 324 may include transistors 356A-D that are matched such that current flowing in each of transistors 356A-D may precisely correspond with current flowing in the other transistors 356A-D.

Voltage sensing unit 322 may include transistors 360-368. In the example of FIG. 3, transistors 360-368 may be matched such that current flowing in each of transistors 360-368 may precisely correspond with current flowing in the other transistors 360-368. In this manner, transistors 368 and 367 may form a p-channel source following that detects a voltage at load 304 and mirrors, by a scaling factor of 1:M, the voltage at a drain of transistor 368. Additionally, transistors 360-366 may form an n-channel source follower that ensures that a stability of circuit 300 by providing current into the p-channel source follower formed by transistors 367 and 368 when the current at load 304 drops to about zero. As shown, transistors 360-368 may operate without a current from charge pump 334 of voltage source 302, thereby reducing a quiescent current of circuit 300.

Figure 4:
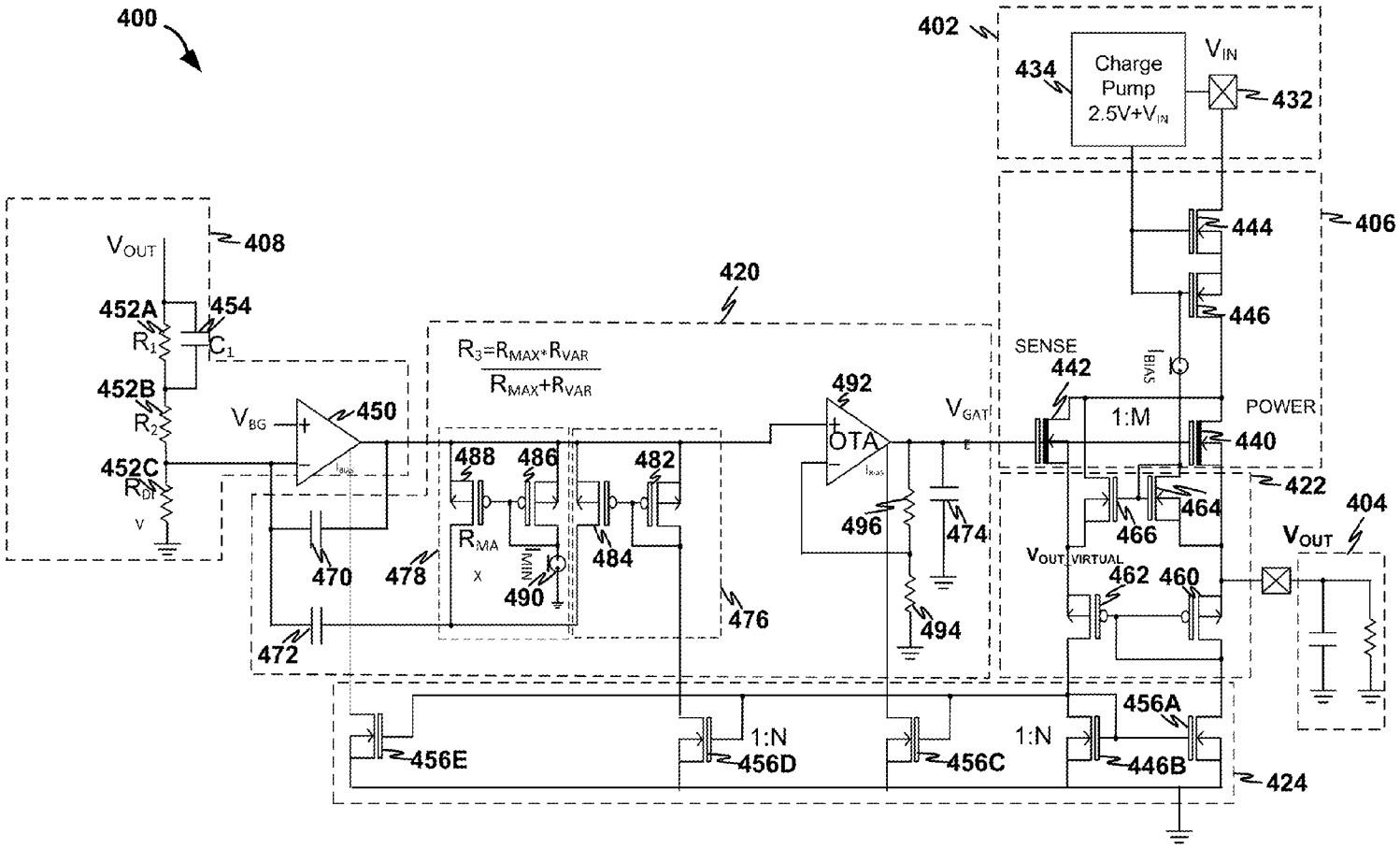
FIG. 4 is a circuit diagram illustrating an example third circuit of the system of FIG. 1, in accordance with one or more techniques of this disclosure.

FIG. 4 is a circuit diagram illustrating an example third circuit 400 of system 100 of FIG. 1, in accordance with one or more techniques of this disclosure. As illustrated, circuit 400 includes voltage source 402, load 404, pass module 406, differential amplifier module 408, and zero generation unit 420, voltage sensing unit 422, and current sensing unit 424.

Voltage source 402 may be substantially similar to voltage source 202 of FIG. 2. For example, voltage source 402 may include input voltage 432 that is substantially similar to input voltage 232 of FIG. 2 and charge pump 434 that is substantially similar to charge pump 234 of FIG. 2. Load 404 may be substantially similar to load 204 of FIG. 2. For example, load 404 may be resistive and capacitive.

Pass module 406 may be substantially similar to pass module 206 of FIG. 2. For example, pass module 406 may include load pass element 440 that is substantially similar to load pass element 240 of FIG. 2, mirrored pass element 442 that is substantially similar to mirrored pass element 242 of FIG. 2, first pass element 444 that is substantially similar to first pass element 244 of FIG. 2, and second pass element 446 that is substantially similar to second pass element 246 of FIG. 2.

Differential amplifier module 408 may be substantially similar to differential amplifier module 208 of FIG. 2. For example, differential amplifier module 408 may include differential amplifier unit 450 that is substantially similar to differential amplifier unit 250 of FIG. 2, resistive elements 452A, 452B, and 452C ("set of resistive elements 452") that are substantially similar to set of resistive elements 252 of FIG. 2, and capacitor 454 that is substantially similar to capacitor 254.

Voltage sensing unit 422 may be substantially similar to voltage sensing unit 222 of FIG. 2. For example, voltage sensing unit 422 may include transistors 460 and 462 that form a p-channel source following that detects a voltage at load 404 and mirrors, by a scaling factor of 1:M, the voltage at a drain of transistor 462 and transistors 464 and 466 may form an n-channel source follower that ensures that a stability of circuit 400 by providing current into the p-channel source follower formed by transistors 460 and 462 when the current at load 404 drops to zero.

Current sensing unit 424 may be configured to mirror current flow at load 204. As shown, current sensing unit 424 includes transistors 456A-E. In some examples, transistors 456A-E may be matched such that current flowing in each of transistors 456A-E may precisely correspond with current flowing in the other transistors 456A-E. In this manner, a current at load 404 may be detected by transistor 456A and mirrored, by a scaling factor of 1:M, by transistor 456B, which in turn is mirrored, by a scaling factor of 1:N, by transistor 456C, which in turn is mirrored, by a scaling factor of 1:N, by transistor 456D, which in turn is mirrored by transistor 456E to provide a current bias to differential amplifier unit 450 of differential amplifier module 408.

Zero generation unit 420 may be configured to generate a zero at an open-loop transfer function's crossover frequency. As shown, zero generation unit 420 includes capacitors 470, 472, and 474, and transistor units 476 and 478 that are substantially similar to capacitors 270, 272, and 274, and transistor units 276 and 278. For example, transistor unit 476 includes transistors 482 and 484 that are substantially similar to transistors 282 and 284 of FIG. 2 and transistor unit 478 includes transistors 486, 488, and current source 490 that are substantially similar to transistors 286, 288, and current source 290 of FIG. 2.

As shown, zero generation unit 420 further includes operational transconductance amplifier 492 and resistive elements 494 and 496. In some examples, zero generation unit 420 may move, before outputting a control signal to mirrored pass element 442, a pole of the transfer function to a higher frequency than a frequency of the pole before moving the pole. For instance, operational transconductance amplifier 492 may be configured to drive the operation of mirrored pass element 442 and to shift a pole that would be formed by the output impedance of differential amplifier unit 450 of differential amplifier module 408 and a capacitance of capacitor 474 in order to improve a stability of circuit 400. In this manner, operational transconductance amplifier 492 may increase a switching speed of pass module 406 and improve a control stability of circuit 400. Additionally, operational transconductance amplifier 492 may transition zero generation unit 420 from a low voltage domain (e.g., 1 volt to 4 volts) to a high voltage domain (e.g., 4 volts to 50 volts).

Figure 5:
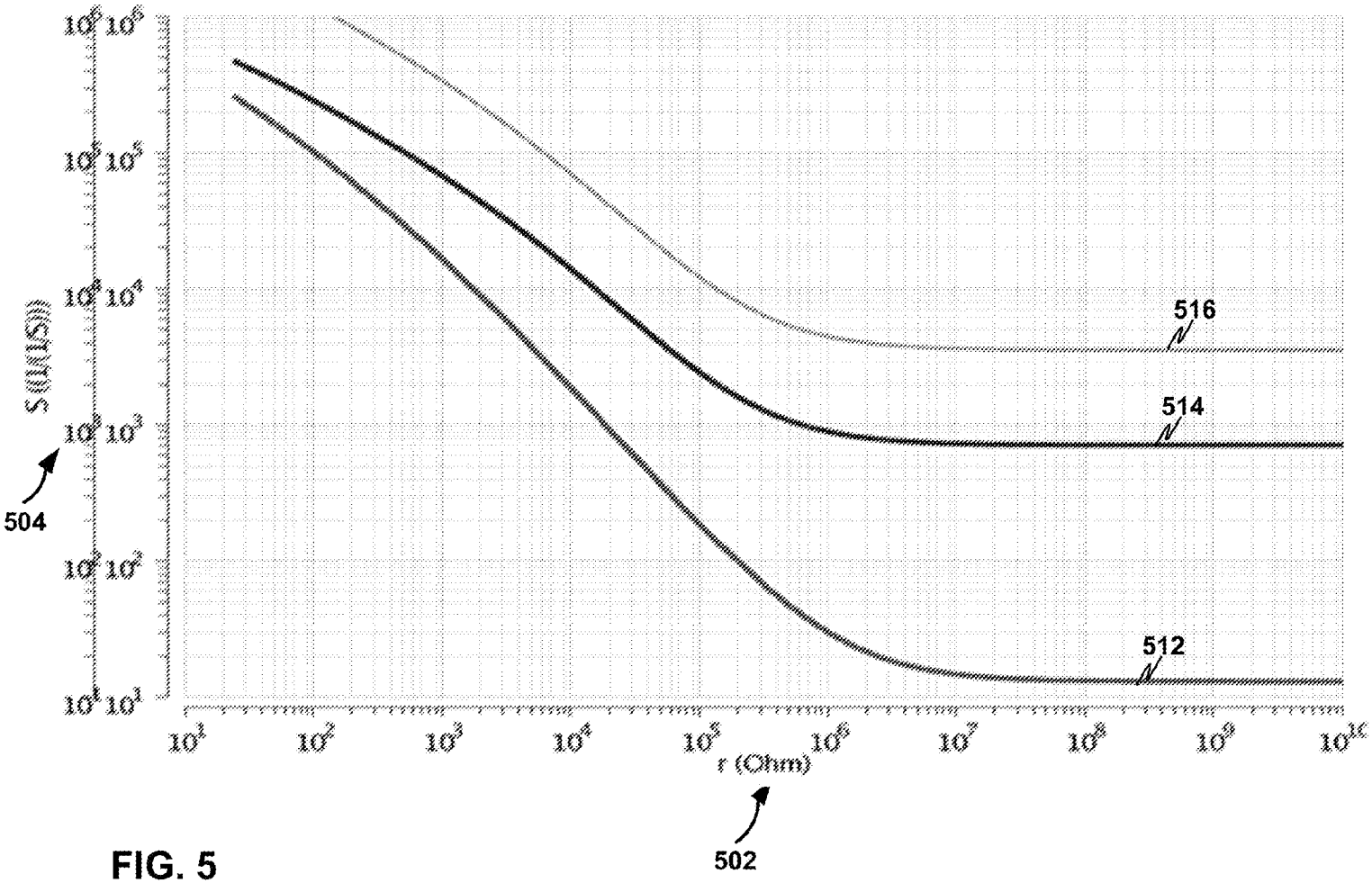
FIG. 5 is a first illustration of a performance of the system of FIG. 1, in accordance with one or more techniques of this disclosure.

FIG. 5 is a first illustration of a performance of system 100 of FIG. 1, in accordance with one or more techniques of this disclosure. For purposes of illustration only, the example performance is described below within the context of system 100 of FIG. 1, circuit 200 of FIG. 2, circuit 300 of FIG. 3, and circuit 400 of FIG. 4. FIG. 5 illustrates an x-axis 502 indicating an output impedance of load 104 and a y-axis 504 indicating a frequency. As shown, FIG. 5 includes a first curve 514 for the zero ("$ZERO_{VAR}$") positioned, by control module 110, substantially at the crossover frequency of the transfer function, a second curve 516 for the pole ("$POLE_2$") following the $ZERO_{VAR}$, and a third curve 512 for the load pole ("$POLE_{LOAD}$"). More specifically, the transfer function of circuit 200 of FIG. 2 may be $$\frac{V_{GATE}}{V_{OUT}} = \frac{(1 + sC_3R_3)(1 + sC_1R_1)}{sR_1(sR_3C_2C_3 + C_2 + C_3)},$$

where $C_1$ corresponds to capacitor 254, $C_2$ corresponds to capacitor 270, $C_3$ corresponds to capacitor 272, $R_1$ corresponds to resistive element 252A, $R_2$ corresponds to resistive element 252B, and $R_3$ corresponds to an effective resistance formed by transistor units 276 and 278. The effective resistance formed by transistor units 276 and 278 may be represented as $$R_3 = \frac{R_{MAX} * R_{VAR}}{R_{MAX} + R_{VAR}},$$

where $R_{MAX}$ is formed by transistor unit 278 and $R_{VAR}$ is formed by transistor unit 276. In examples where $R_2$ is not used, the resulting transfer function yields $$\text{ZERO}_{VAR} = \frac{1}{R_3 * C_3}$$

and $$z_2 = \frac{1}{R_1 * C_1}$$

and $p_1$=0 and $$\text{POLE}_2 = \frac{C_2 + C_3}{C_2 * C_3 * R_3}.$$

As shown in FIG. 5, second curve 516 for $POLE_2$ does not interfere with the open loop transfer function since second curve 516 for $POLE_2$ follows close to the open-loop transfer function crossover frequency. Additionally, as shown, first curve 514 for $ZERO_{VAR}$ does not follow third curve 512 for $POLE_{LOAD}$.

Figure 6:
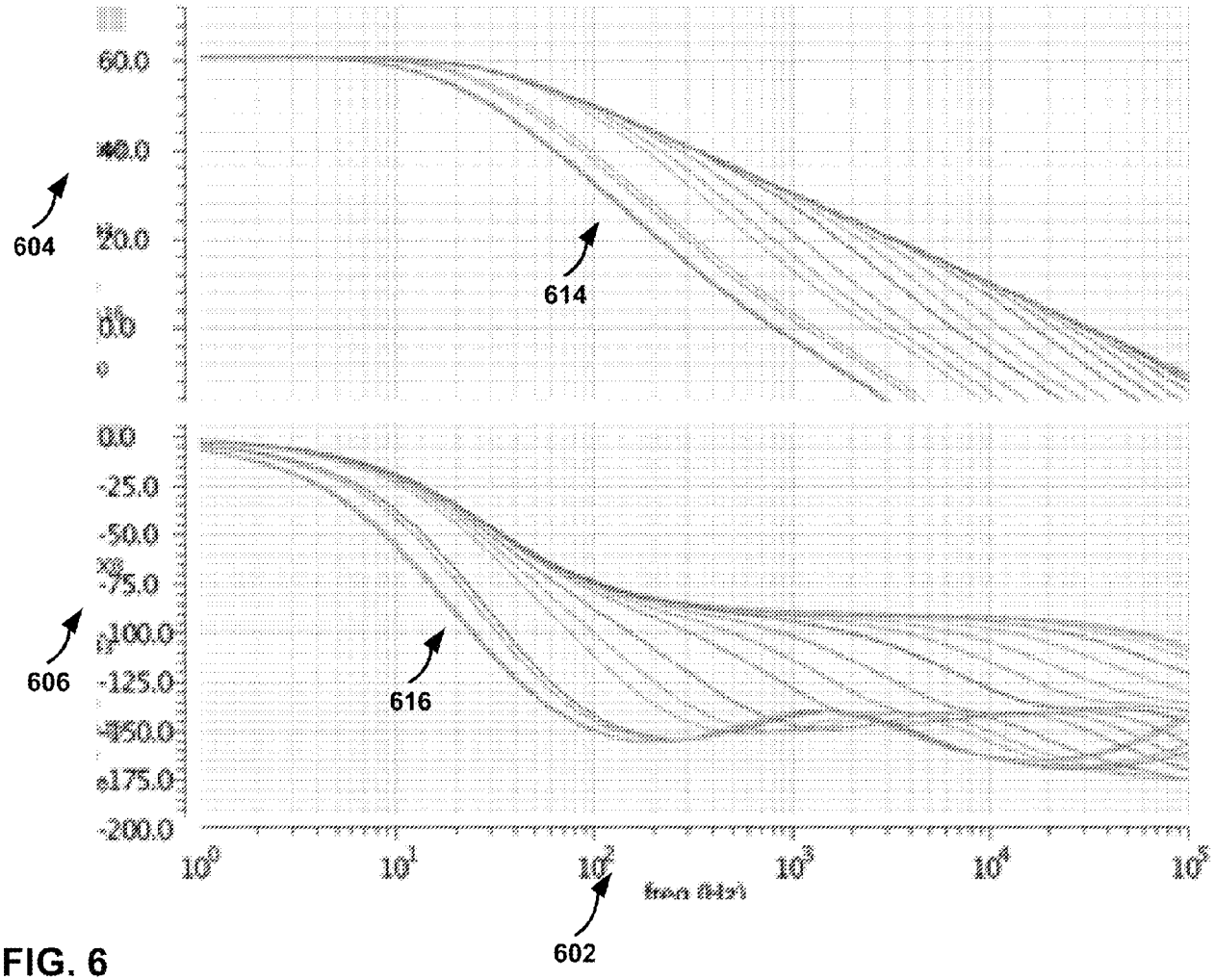
FIG. 6 is a second illustration of a performance of the system of FIG. 1, in accordance with one or more techniques of this disclosure.

FIG. 6 is a second illustration of a performance of system 100 of FIG. 1, in accordance with one or more techniques of this disclosure. For purposes of illustration only, the example performance is described below within the context of system 100 of FIG. 1, circuit 200 of FIG. 2, circuit 300 of FIG. 3, and circuit 400 of FIG. 4. FIG. 6 illustrates an x-axis 602 indicating a frequency, a first y-axis 604 indicating a gain in decibels, and a second y-axis 606 indicating a phase shift. As shown, FIG. 6 includes curves 614 for impedances ranging from 24 ohms (Ω) to 100 kilo-ohms (kΩ) for load 104 that are plotted along first y-axis 604 and curves 616 for impedances ranging from 24 ohms (Ω) to 100 kilo-ohms (kΩ) for load 104 that are plotted along second y-axis 606. As shown, curves 614 show a zero positioned substantially at the crossover frequency of the transfer function for system 100.

Figure 7:
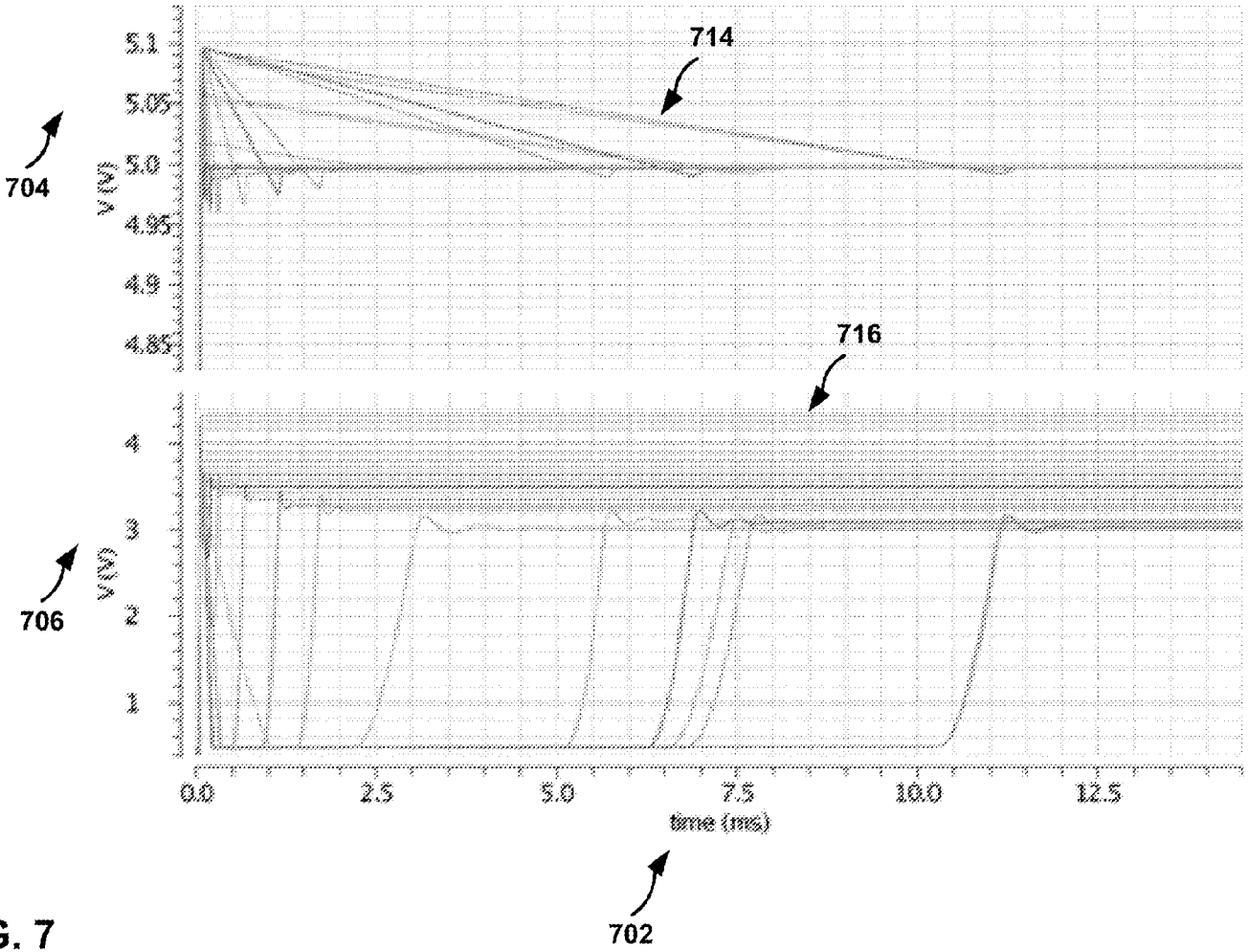
FIG. 7 is a third illustration of a performance of the system of FIG. 1, in accordance with one or more techniques of this disclosure.

FIG. 7 is a third illustration of a performance of system 100 of FIG. 1, in accordance with one or more techniques of this disclosure. For purposes of illustration only, the example performance is described below within the context of system 100 of FIG. 1, circuit 200 of FIG. 2, circuit 300 of FIG. 3, and circuit 400 of FIG. 4. FIG. 7 illustrates an x-axis 702 indicating a time in milliseconds ("ms"), a first y-axis 704 indicating a voltage at load 104, and a second y-axis 706 indicating a voltage at a gate of pass module 106, for example, but not limited to, a voltage at the gate of mirrored pass element 242 of FIG. 2, a voltage at the gate of mirrored pass element 342 of FIG. 3, and a voltage at the gate of mirrored pass element 442 of FIG. 4. As shown, FIG. 7 includes curves 714 for impedances ranging from 24 ohms (Ω) to 10 giga-ohms (GΩ) for load 104 that are plotted along first y-axis 704 and curves 716 for impedances ranging from 24 ohms (Ω) to 10 giga-ohms (GΩ) for load 104 that are plotted along second y-axis 706. As shown, the zero positioned, by control module 110, substantially at the crossover frequency of the transfer function permits the transient response of system 100 to remain stable for a range of load current at load 104 of between about 0.5 nano-amperes (nA) and about 200 milli-amperes (mA).

Figure 8:
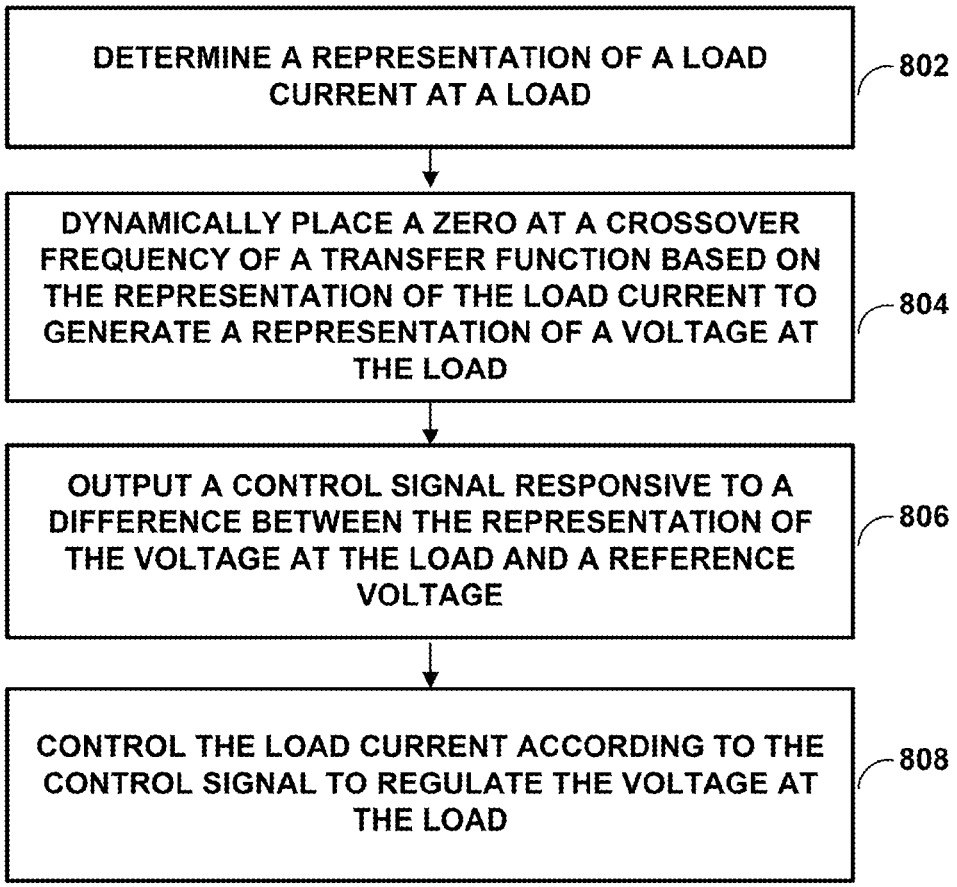
FIG. 8 is a flow diagram consistent with techniques that may be performed by a circuit in accordance with this disclosure.

FIG. 8 is a flow diagram consistent with techniques that may be performed by a circuit in accordance with this disclosure. For purposes of illustration only, the example operations are described below within the context of system 100 of FIG. 1, circuit 200 of FIG. 2, circuit 300 of FIG. 3, and circuit 400 of FIG. 4. However, the techniques described below can be used in any permutation, and in any combination, with voltage source 102, load 104, pass module 106, differential amplifier module 108, and control module 110.

In accordance with one or more techniques of this disclosure, control module 110 determines a representation of a load current at a load (802). For example, current sensing unit 124 of control module 110 mirrors the current flowing from voltage source 102, via pass module 106, to load 104. Control module 110 dynamically generate a zero at a crossover frequency of a transfer function based on the representation of the load current to generate a representation of a voltage at the load (804). For example, transistor unit 276 of FIG. 2 electronically couples, using a channel having a resistance, an output of differential amplifier unit 250 of differential amplifier module 208 to, via capacitor 272, a second input (e.g., negative) of differential amplifier unit 250 of differential amplifier module 208, where the resistance of the channel is proportional to the current mirrored by transistor 256C of current sensing unit 224. Differential amplifier module 108 outputs a control signal responsive to a difference between the representation of the voltage at the load and a reference voltage (806). For example, differential amplifier module 108 generate a differential signal based on a comparison of a voltage reference and the representation of the voltage at load 104 that is output by voltage sensing unit 122. Pass module 106 controls the load current according to the control signal (808) to regulate the voltage at the load. For example, load pass element 240 of FIG. 2 electronically couples, using a channel having a resistance, voltage source 202 and load 204 and load pass element 240 modifies the resistance of the channel based on a control output of mirrored pass element 242, which is based on the differential output of differential amplifier unit 250. In some examples, load pass element 440 of FIG. 4 electronically couples, using a channel having a resistance, voltage source 402 and load 404 and load pass element 440 modifies the resistance of the channel based on a control output of mirrored pass element 442, which is based on an output of operational transconductance amplifier 492, which is based on the differential output of differential amplifier unit 250.

The following examples may illustrate one or more aspects of the disclosure.

Example 1

A circuit comprising: a voltage source; a pass module configured to electronically couple, using a channel having a resistance, the voltage source and a load and to modify the resistance of the channel based on a control signal; a differential amplifier module configured to generate a differential signal based on a comparison of a voltage reference and a representation of a voltage at the load, wherein the control signal is based on the differential signal; and a control module configured to generate the representation of the voltage at the load according to a transfer function, the transfer function including a zero positioned substantially at a crossover frequency of the transfer function.

Example 2

The circuit of example 1, wherein: the differential amplifier module comprises a differential amplifier unit, the differential amplifier unit comprising: a first input configured to receive the voltage reference; a second input configured to receive the representation of the voltage at the load; and an output configured to output the differential signal; and the control module comprises: a capacitor coupled to the second input of the differential amplifier unit; and a transistor unit configured to electronically couple, using a channel having a resistance, the capacitor and the output of the differential amplifier unit and to modify the resistance of the channel of the transistor element based on a representation of a current at the load.

Example 3

The circuit of any combination of examples 1-2, wherein the control module further comprises: a second transistor unit configured to electronically couple the capacitor and the output of the differential amplifier unit with a resistance that represents a maximum resistance between the capacitor and the output of the differential amplifier unit.

Example 4

The circuit of any combination of examples 1-3, wherein the capacitor is a first capacitor and wherein the control module further comprises: a second capacitor coupled to the second input of the differential amplifier unit and coupled to the output of the differential amplifier unit.

Example 5

The circuit of any combination of examples 1-4, wherein the differential amplifier module comprises: a set of resistive elements configured to receive the voltage at the load and to output, to the first and second capacitors, a voltage corresponding to the voltage at the load.

Example 6

The circuit of any combination of examples 1-5, wherein the control module comprises: a current sensing unit configured to mirror current flow at the load to generate the representation of the current at the load.

Example 7

The circuit of any combination of examples 1-6, wherein the control module comprises: a voltage sensing unit configured to mirror the voltage output by the pass module to the load.

Example 8

The circuit of any combination of examples 1-7, wherein the pass module comprises: a mirrored pass element configured to receive the differential signal and to generate the control signal; and a load pass element configured to modify the resistance of the channel based on the control signal.

Example 9

The circuit of any combination of examples 1-8, wherein: the load pass element comprises a first node, a second node coupled to the load, and a control node, the control node being configured to receive the control signal from the mirrored pass element; and the mirrored pass element comprises a first node coupled to the first node of the load pass element, a second node coupled to the control node of the load pass element, and a control node configured to receive the differential signal from the differential amplifier module.

Example 10

The circuit of any combination of examples 1-9, wherein: the control signal is a first control signal; the control module comprises an operational transconductance amplifier configured to receive the differential signal and to generate a second control signal; and the pass module comprises: a mirrored pass element configured to receive the second control signal from the operational transconductance amplifier and to generate the first control signal; and a load pass element configured to modify the resistance of the channel based on the first control signal.

Example 11

The circuit of any combination of examples 1-10, wherein the pass module comprises: a first pass element configured to further reduce the voltage at the load when the pass module operates in an off state; and a second pass element configured to prevent current to flow from the load to the voltage source.

Example 12

The circuit of any combination of examples 1-11, wherein the voltage source comprises: a charge pump configured to receive a voltage to be output, via the pass module, to the load, and configured to supply a voltage that is greater than the received voltage to a control input of the first pass element and to a control input of the second pass element.

Example 13

A method comprising: determining, by a circuit, a representation of a load current at a load; generating, by the circuit, a zero at a crossover frequency of a transfer function for controlling a voltage at the load to generate a representation of a voltage at the load, the generating the zero at the crossover frequency of the transfer function being based on the representation of the load current; outputting, by the circuit, a control signal responsive to a difference between the representation of the voltage at the load and a reference voltage; and controlling, by the circuit, the voltage at the load according to the control signal.

Example 14

The method of example 13, further comprising: moving, by the circuit and before outputting the control signal, a pole of the transfer function to a higher frequency than a frequency of the pole before moving the pole.

Example 15

The method of any combination of examples 13-14, further comprising: mirroring, by the circuit, the load current to determine the representation of the load current.

Example 16

The method of any combination of examples 13-15, further comprising: mirroring, by the circuit, the control signal to control the voltage at the load according to the control signal.

Example 17

A circuit comprising: a current sensing unit configured to determine a representation of a load current at a load; a zero generation unit configured to generate a zero at a crossover frequency of a transfer function for controlling a voltage at the load to generate a representation of a voltage at the load, the zero at the crossover frequency of the transfer function being based on the representation of the load current; a differential amplifier module configured to output a control signal responsive to a difference between the representation of the voltage at the load and a reference voltage; and a pass module configured to control the voltage at the load according to the control signal.

Example 18

The circuit of example 17, wherein the zero generation unit is further configured to: move, before outputting the control signal, a pole of the transfer function to a higher frequency than a frequency of the pole before moving the pole.

Example 19

The circuit of any combination of examples 17-18, wherein the current sensing unit is further configured to: mirror the load current to determine the representation of the load current.

Example 20

The circuit of any combination of examples 17-19, wherein the pass module is further configured to: mirror the control signal to control the voltage at the load according to the control signal.

Various aspects have been described in this disclosure. These and other aspects are within the scope of the following claims.

The invention claimed is:

1. A circuit comprising:

a voltage source;

a pass module configured to electronically couple, using a channel having a resistance, the voltage source and a load and to modify the resistance of the channel based on a control signal;

a differential amplifier module configured to generate a differential signal based on a comparison of a voltage reference and a representation of a voltage at the load, wherein the control signal is based on the differential signal and wherein the differential amplifier module comprises a differential amplifier unit, the differential amplifier unit comprising a first input configured to receive the voltage reference, a second input configured to receive the representation of the voltage at the load, and an output configured to output the differential signal; and a control module configured to generate the representation of the voltage at the load according to a transfer function, the transfer function including a zero positioned substantially at a crossover frequency of the transfer function, wherein the control module comprises a capacitor coupled to the second input of the differential amplifier unit and a transistor unit configured to electronically couple, using a second channel having a resistance, the capacitor and the output of the differential amplifier unit and to modify the resistance of the second channel based on a representation of a current at the load.

2. The circuit according to claim 1, wherein the control module further comprises:

a second transistor unit configured to electronically couple the capacitor and the output of the differential amplifier unit with a resistance that represents a maximum resistance between the capacitor and the output of the differential amplifier unit.

3. The circuit according to claim 2, wherein the capacitor is a first capacitor and wherein the control module further comprises:

a second capacitor coupled to the second input of the differential amplifier unit and coupled to the output of the differential amplifier unit.

4. The circuit according to claim 3, wherein the differential amplifier module comprises:

a set of resistive elements configured to receive the voltage at the load and to output, to the first and second capacitors, a voltage corresponding to the voltage at the load.

5. The circuit according to claim 1, wherein the control module comprises:

a current sensing unit configured to mirror current flow at the load to generate the representation of the current at the load.

6. The circuit according to claim 1, wherein the control module comprises:

a voltage sensing unit configured to mirror the voltage output by the pass module to the load.

7. The circuit according to claim 1, wherein the pass module comprises:

a mirrored pass element configured to receive the differential signal and to generate the control signal; and a load pass element configured to modify the resistance of the channel based on the control signal.

8. The circuit according to claim 7, wherein:

the load pass element comprises a first node, a second node coupled to the load, and a control node, the control node being configured to receive the control signal from the mirrored pass element; and the mirrored pass element comprises a first node coupled to the first node of the load pass element, a second node coupled to the control node of the load pass element, and a control node configured to receive the differential signal from the differential amplifier module.

9. The circuit according to claim 1, wherein:

the control signal is a first control signal;

the control module comprises an operational transconductance amplifier configured to receive the differential signal and to generate a second control signal; and the pass module comprises:

a mirrored pass element configured to receive the second control signal from the operational transconductance amplifier and to generate the first control signal; and a load pass element configured to modify the resistance of the channel based on the first control signal.

10. The circuit according to claim 1, wherein the pass module comprises:

a first pass element configured to further reduce the voltage at the load when the pass module operates in an off state; and a second pass element configured to prevent current to flow from the load to the voltage source.

11. The circuit according to claim 10, wherein the voltage source comprises:

a charge pump configured to receive a voltage to be output, via the pass module, to the load, and configured to supply a voltage that is greater than the received voltage to a control input of the first pass element and to a control input of the second pass element.

12. A method comprising:

determining, by a circuit, a representation of a load current at a load;

generating, by the circuit, a zero at a crossover frequency of a transfer function for controlling a voltage at the load to generate a representation of a voltage at the load, the generating the zero at the crossover frequency of the transfer function being based on the representation of the load current, wherein generating the zero comprises modifying a resistance of a channel of a transistor of the circuit based on the representation of the load current such that a capacitance of a capacitor of the circuit and the resistance of the channel position the zero at the crossover frequency of the transfer function;

outputting, by the circuit, a differential signal responsive to a difference between the representation of the voltage at the load and a reference voltage; and controlling, by the circuit, the voltage at the load according to a control signal, wherein the control signal is based on the differential signal.

13. The method according to claim 12, further comprising:

moving, by the circuit and before outputting the control signal, a pole of the transfer function to a higher frequency than a frequency of the pole before moving the pole.

14. The method according to claim 12, further comprising:

mirroring, by the circuit, the load current to determine the representation of the load current.

15. The method according to claim 12, further comprising:

mirroring, by the circuit, the control signal to control the voltage at the load according to the control signal.

16. A circuit comprising:

a current sensing unit configured to determine a representation of a load current at a load;

a zero generation unit configured to generate a zero at a crossover frequency of a transfer function for controlling a voltage at the load to generate a representation of a voltage at the load, the zero at the crossover frequency of the transfer function being based on the representation of the load current, wherein to generate the zero, the zero generation unit is configured to modify a resistance of a channel of a transistor of the zero generation unit based on the representation of the load current such that a capacitance of a capacitor of the zero generation unit and the resistance of the channel position the zero at the crossover frequency of the transfer function;

a differential amplifier module configured to output a differential signal responsive to a difference between the representation of the voltage at the load and a reference voltage; and a pass module configured to control the voltage at the load according to a control signal, wherein the control signal is based on the differential signal.

17. The circuit according to claim 16, wherein the zero generation unit is further configured to:

move, before outputting the control signal, a pole of the transfer function to a higher frequency than a frequency of the pole before moving the pole.

18. The circuit according to claim 16, wherein the current sensing unit is further configured to:

mirror the load current to determine the representation of the load current.

19. The circuit according to claim 16, wherein the pass module is further configured to:

mirror the control signal to control the voltage at the load according to the control signal.

* * * * *